US005614929A

United States Patent [19]

Dangelo et al.

[11] Patent Number: 5,614,929

[45] Date of Patent: *Mar. 25, 1997

[54] MANUAL PEN SELECTION FOR CLEARING NOZZLES WITHOUT REMOVAL FROM PEN CARRIAGE

[75] Inventors: Michael T. Dangelo, San Diego; Kevin L. Glassett, Escondido; Stephen W. Bauer, San Diego, all of Calif.

[73] Assignee: Hewlett-Packard Company, Palo Alto, Calif.

[ * ] Notice: The term of this patent shall not extend beyond the expiration date of Pat. No. 5,450,105.

[21] Appl. No.: 235,630

[22] Filed: Apr. 29, 1994

Related U.S. Application Data

[63] Continuation of Ser. No. 56,326, Apr. 30, 1993, Pat. No. 5,450,105, and a continuation of Ser. No. 56,012, Apr. 30, 1993, Pat. No. 5,420,619.

[51] Int. Cl.[6] ..... B41J 2/165

[52] U.S. Cl. ..... 347/30; 347/24

[58] Field of Search ..... 347/29, 30, 32, 347/24

[56] References Cited

U.S. PATENT DOCUMENTS

| | | | |
|---|---|---|---|
| 3,930,761 | 1/1976 | Barraclough | 417/476 |
| 4,410,900 | 10/1983 | Terasawa | 347/30 |
| 4,543,591 | 9/1985 | Terasawa | 346/140 R |
| 4,577,203 | 3/1986 | Kawamura | 347/30 |
| 4,600,931 | 7/1986 | Terasawa | 347/30 |
| 4,853,717 | 8/1989 | Harmon et al. | 347/29 |
| 5,420,619 | 5/1995 | Glassett et al. | 347/30 |
| 5,450,105 | 9/1995 | Dangelo | 347/30 |

FOREIGN PATENT DOCUMENTS

| | | |
|---|---|---|
| 0569155 | 11/1993 | European Pat. Off. . |
| 58-194568 | 11/1983 | Japan . |
| 59-78858 | 5/1984 | Japan . |
| 63-224957 | 9/1988 | Japan . |

OTHER PUBLICATIONS

Patent Abstracts of Japan, vol. 16, No. 456 (M–1314) 22 Sep. 1992 & SP–A–04 161 343 (I. Takuro) 4 Jun. 1992.

*Primary Examiner*—John E. Barlow, Jr.

[57] ABSTRACT

A thermal ink jet printhead cartridge priming apparatus that includes a plurality of caps respectively associated with a plurality of printhead nozzle arrays for controllably sealing printhead nozzle arrays pursuant to engagement thereof against the printhead cartridge to surround the nozzle arrays, a plurality of vacuum conveying elements respectively associated with the caps for individually conveying priming vacuum to an associated cap, a manually actuated selector assembly for connecting a selected one of the vacuum conveying elements to a source of priming vacuum, and a source of priming vacuum spaced apart from the manually actuated selection means for selectively engaging the selector assembly for application of vacuum thereto, such that a selected printhead cartridge is primed without removal thereof from the carriage and without use of a motorized vacuum pump. By separating the vacuum source from the selector, positive pressure is not applied to the nozzle arrays when the caps are brought into engagement with the printhead cartridges since venting is provided by the unobstructed vacuum conveying elements.

3 Claims, 10 Drawing Sheets

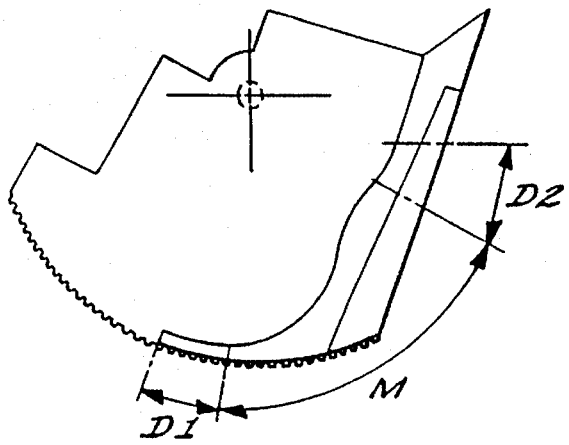
FIG. 15
FIG. 16
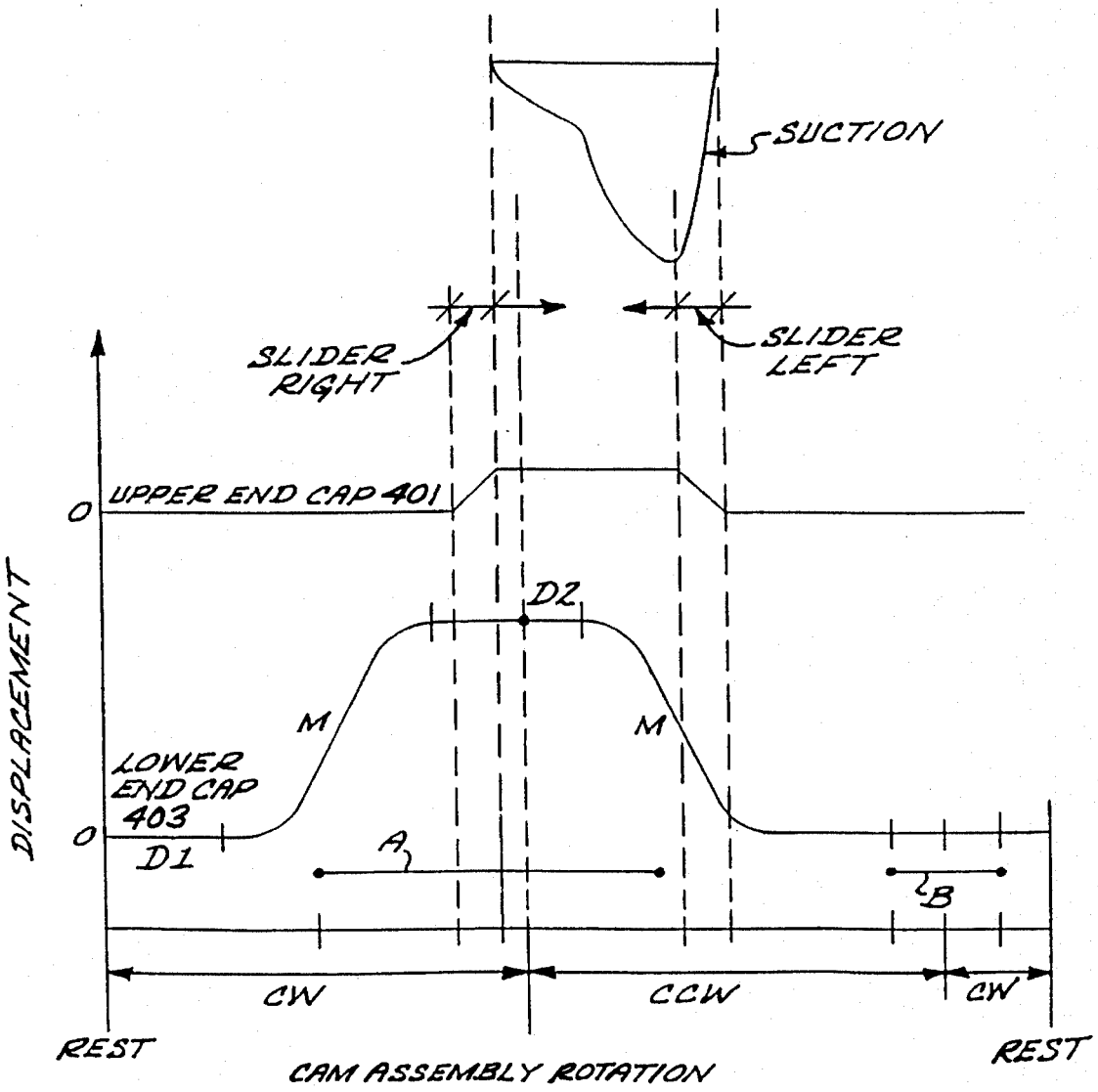

MANUAL PEN SELECTION FOR CLEARING NOZZLES WITHOUT REMOVAL FROM PEN CARRIAGE

This is a continuation of U.S. application Ser. No. 08/056,326, filed Apr. 30, 1993, by M. T. Dangelo for "MANUAL PEN SELECTION FOR CLEARING NOZZLES WITHOUT REMOVAL FROM PEN CARRIAGE", U.S. Pat. No. 5,450,105, and U.S. application Ser. No. 08/056,012, filed Apr. 30, 1993, by K. L. Glassett and S. W. Bauer for "IN-LINE/OFF-LINE PRIMER FOR INK JET CARTRIDGE", U.S. Pat. No. 5,420,619.

BACKGROUND OF THE INVENTION

The subject invention generally relates to ink-jet printer technology, and is directed more particularly to an apparatus for priming a thermal ink jet printhead cartridge without removal of the printhead cartridge from the printer carriage.

Thermal ink jet printers commonly utilize printhead cartridges, often called pens, which typically include one or more ink reservoirs and an integrated circuit printhead that includes a nozzle plate having an array of ink ejecting nozzles which emit ink droplets in response to electrical pulses provided to the printhead.

An important consideration with thermal ink jet printhead cartridges is the need to ready a printhead for printing. For example, when a new printhead cartridge is installed in a printer or after a period of non-usage, the cartridge might be unable to produce ink drops at one or more nozzles, for example as a result of foreign contamination of the nozzles, dried ink in the nozzles, or air ingested into the nozzles.

Known systems for priming include those which are involve the application of pressure to the ink supply in order to cause ink flow into the ink containing chambers that are adjacent the ink ejecting nozzles. Considerations with such known systems is need for access to the ink reservoir, and the various mechanical impedances between the ink reservoir and the nozzles which reduce the pressure that eventually reaches the nozzles.

Another known system requires that a printhead cartridge be removed from the printer carriage and inserted into a separate priming station for priming, which further requires that the printhead cartridge be removed from the priming station after priming and inserted back into the carriage. Considerations with these systems include the additional wear and tear on the electrical contacts of the printhead cartridge and the printer carriage, as well as the inconvenience of having to perform the remove and insert procedure two times for one priming.

A further known system includes a movable cap that is engageable with a printhead nozzle array and is directly connected to a tube of a peristaltic pump. Considerations with this system, however, include the need for separate pump for each printhead of a multiple printhead carriage, and clogging of the pump tube with ink.

SUMMARY OF THE INVENTION

It would therefore be an advantage to provide an improved ink jet printhead cartridge primer which provides for priming of a printhead cartridge nozzle array without removal of the printhead cartridge from the printer, avoids application of positive pressure to the printhead nozzle array, avoids clogging of vacuum conveying elements, and allows the use of a single vacuum source for priming each of a plurality of printhead cartridges of a multiple printhead printer.

The foregoing and other advantages are provided by the invention in a thermal ink jet printer that includes a print carriage, a printhead cartridge supported by the print carriage, and a manually actuated priming structure for conveying priming vacuum to the nozzle array of the printhead cartridge while the printhead cartridge is supported by the print carriage, such that the printhead cartridge is primed without removal thereof from the carriage and without use of a motorized vacuum pump.

BRIEF DESCRIPTION OF THE DRAWINGS

The advantages and features of the disclosed invention will readily be appreciated by persons skilled in the art from the following detailed description when read in conjunction with the drawing wherein:

FIG. 15 is a schematic elevational view of the profile of certain cam surfaces in a cam assembly of the vacuum source of FIG. 14 which control the displacement of the lower end cap of the bellows of FIG. 12.

FIG. 16 schematically depicts the various displacements of components of the vacuum source of FIG. 14 during the operation thereof.

DETAILED DESCRIPTION OF THE DISCLOSURE

Figure 1:
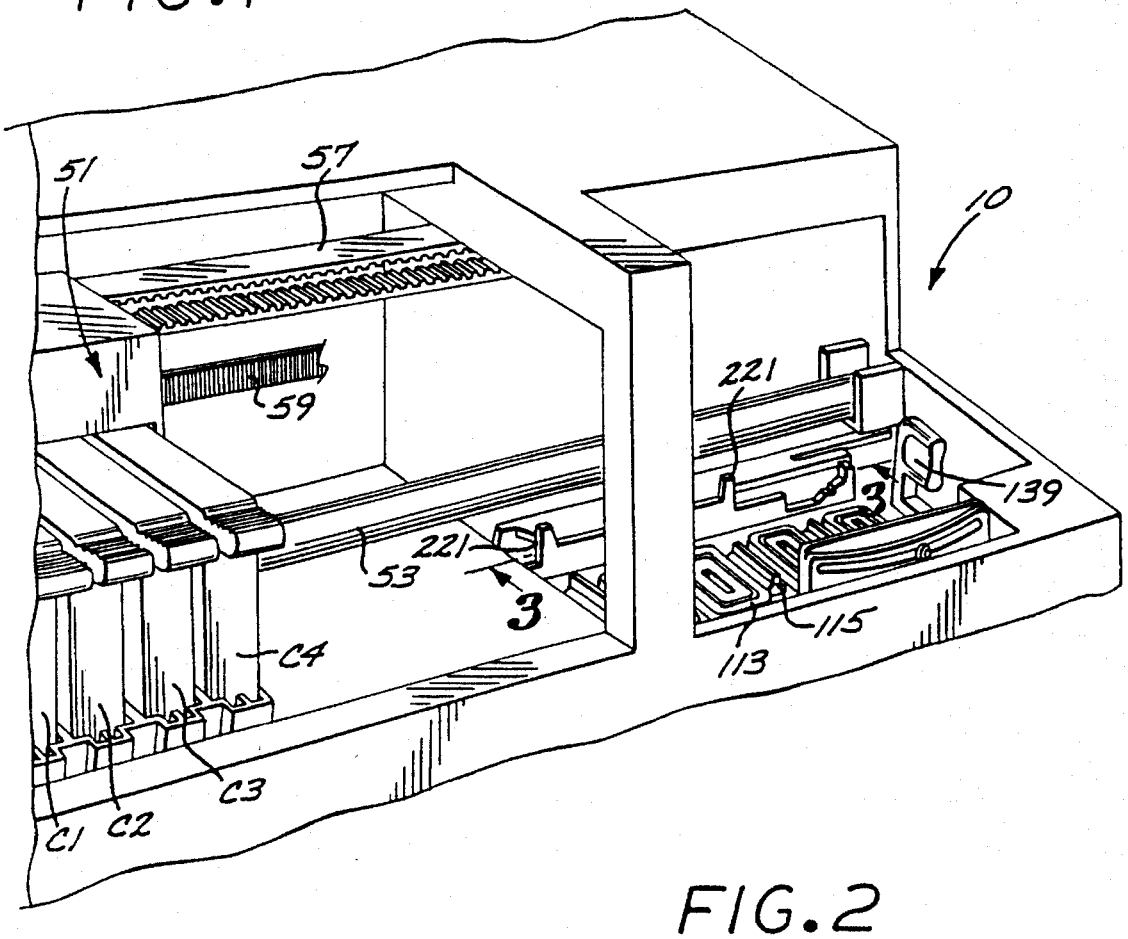
FIG. 1 is a schematic perspective view of the major mechanical components of a thermal ink jet printer that includes primer apparatus in accordance with the invention.
Figure 2:
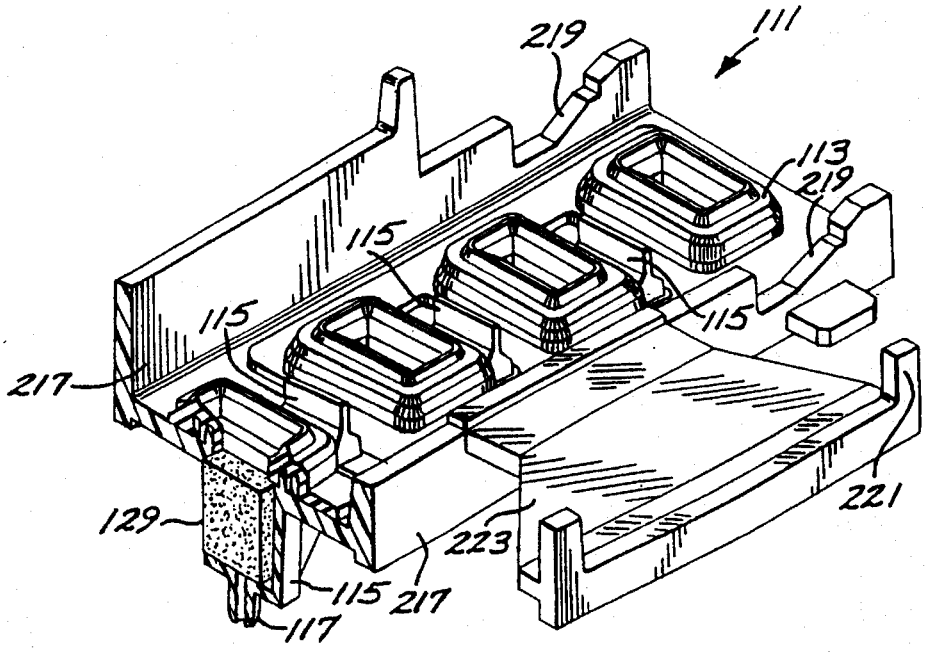
FIG. 2 is a schematic perspective view of the service station sled of the printer of FIG. 1.

In the following detailed description and in the several figures of the drawing, like elements are identified with like reference numerals.

Referring now to FIG. 1, set forth therein is a schematic frontal quarter perspective view depicting, by way of illustrative example, major mechanical components of a multiple printhead ink jet printer in which the techniques of the invention can be implemented. The printer includes a movable carriage 51 mounted on a guide rail 53 for translational movement along the carriage scan axis (commonly called the Y-axis in the printer art). The carriage 51 is driven along the guide rail 53 by an endless belt 57 which can be driven in a conventional manner, and a linear encoder strip 59 is utilized to detect position of the carriage 51 along the carriage scan axis, for example in accordance with conventional techniques.

Figure 18:
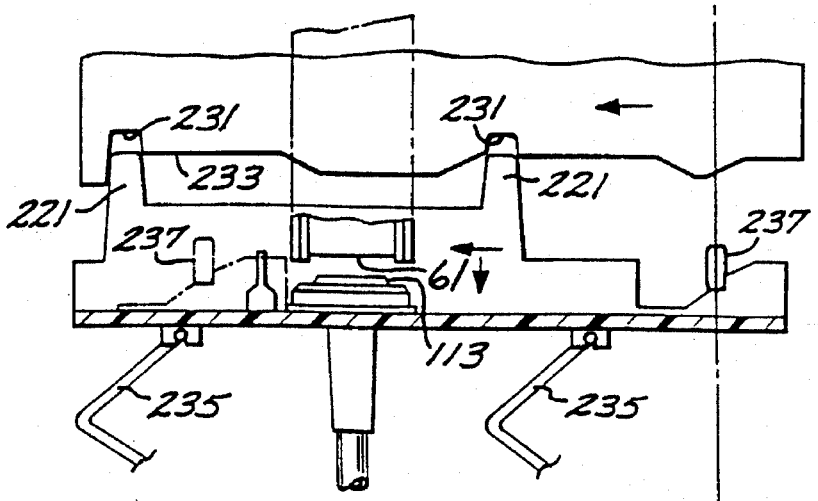
FIG. 18 is a schematic elevational view illustrating the sled of the printer of FIG. 1 as it is moved from the capping position by movement away from the capping location of the carriage that supports the printhead nozzle arrays.
Figure 19:
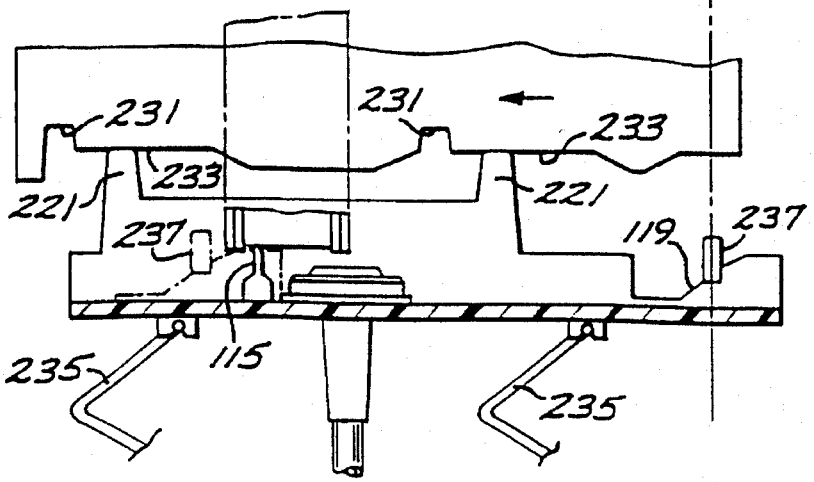
FIG. 19 is a schematic elevational view illustrating the sled of the printer of FIG. 1 in a stationary wiping position wherein printhead nozzle arrays move against wipers on the sled as the carriage continues to move away from the capping location.
Figure 20:
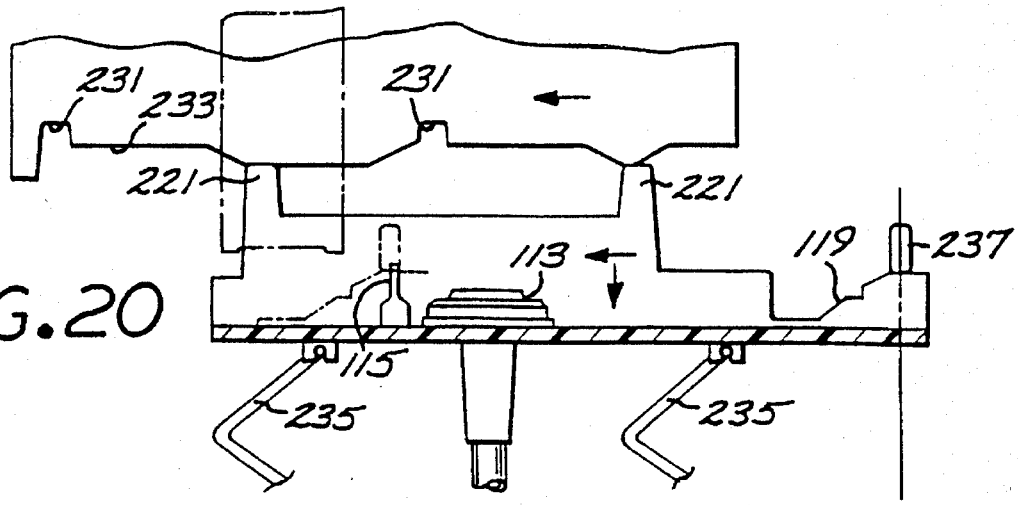
FIG. 20 is a schematic elevational view illustrating the sled of the printer of FIG. 1 as it is moved from the wiping position to the down position as the carriage continues to move away from the capping location after the printhead nozzle arrays have been wiped.
Figure 21:
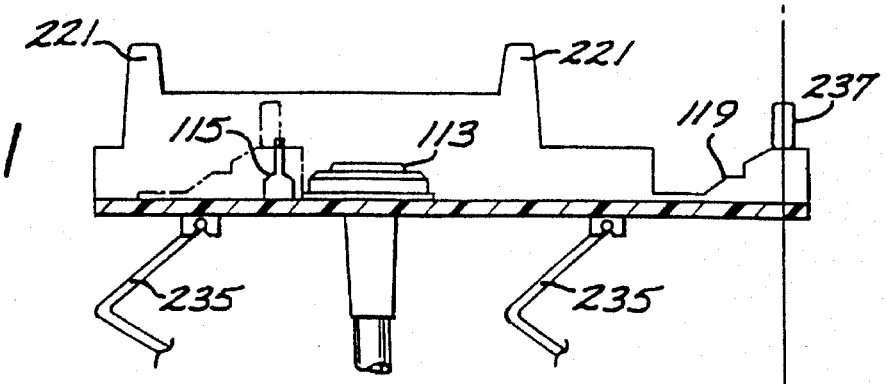
FIG. 21 is a schematic elevational view illustrating the sled of the printer of FIG. 1 in a stationary down position to which it has been moved pursuant to the continued movement of the carriage away from the capping location.
Figure 22:
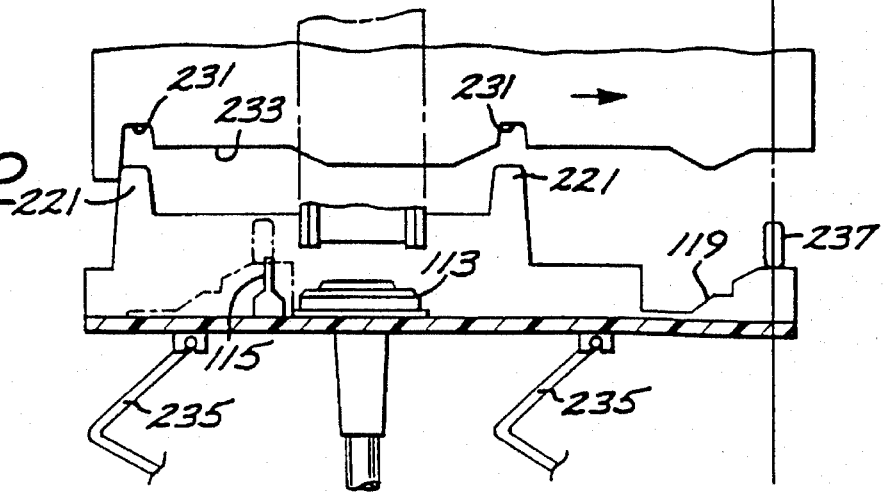
FIG. 22 is a schematic elevational view illustrating the sled of the printer of FIG. 1 as it is engaged by the carriage as the carriage moves toward the capping location.

The carriage 51 removably retains four printhead cartridges C1, C2, C3, C4 (sometimes called "pens," "print cartridges," or "cartridges") which are side by side along the carriage axis. Each of the cartridges C1, C2, C3, C4 includes a nozzle array generally indicated by the reference numeral 61 in FIGS. 3 and 18, comprised of a plurality of downwardly facing nozzles for ejecting ink generally downwardly to a print media which is supported in an appropriate manner below the path traversed by printhead cartridges when the carriage 51 is scanned along the carriage axis. The print media is moved along a print media axis which is orthogonal to the carriage scan axis. In accordance with conventional thermal ink jet printhead architecture, ink drops are fired from the nozzles pursuant to ink firing pulses applied to heater resistors respectively associated with the nozzles and located in the printhead interiorly of the nozzles.

By way of illustrative example, the cartridges C1, C2, C3 comprise non-black color printing cartridges for producing the base colors of yellow, cyan, and magenta as commonly utilized in color printing, while the cartridge C4 comprises a black printing cartridge.

The printer of FIG. 1 further includes a service station located to one side of the media print area and generally indicated by the reference numeral 10. The service station functions to cap the nozzle arrays of the printhead cartridges, and wipe the nozzle arrays. The station more particularly includes a movable sled 111 that includes respective caps 113 configured to cap respective nozzle arrays of the cartridges when the carriage is moved into position over the caps 113. In particular, the caps 113 are designed to a surround the printhead nozzle arrays rather than contact them, so as to reduce drying of ink. The caps 113 further function to convey priming vacuum to the nozzle arrays of the printhead cartridges. The movable sled 111 also includes resilient wipers 115 for wiping the nozzle arrays of the printhead cartridges as described more fully herein.

The movable sled 111 further includes vertical side panels 217 in front of and behind the caps 113, and cam surfaces 219 are formed in the side panels generally adjacent the distal caps. The cam surfaces 219 are mirror images of each other across a vertical plane that is parallel to the carriage axis. The sled also includes two vertically extending cam follower prongs 221 that formed on the front side panel between the cam surfaces 219, and two vertically extending cam follower prongs 221 on a forwardly extending panel 223. The cam following prongs 221 are mirror images of each other across a vertical plane that is parallel to the carriage axis. As shown more fully in FIGS. 17–22, vertical and horizontal movement of the sled 111 is controlled by engagement of the vertical prongs 221 by cam surfaces 233 and slots 231 in the carriage 51 and by the upward engagement of the cam surfaces 219 against stationary guide pegs 237 pursuant to upwardly biasing springs 235. In particular, the cam surfaces 219 and the vertical prongs 221 of the sled, stationary guide pegs 237 engaged with the cam surfaces 219, and the cam surfaces 233 and slots 231 of the carriage 51 that engage the vertical prongs 221 are configured such that the sled 111 is in its vertically highest position, called the capping position, when it is furthest from the print media (i.e., towards the right side of the printer), and is in its vertically lowest position, called the down position, when it is closest to the print media region (i.e., towards the center of the printer). In the capped position, the caps 113 of the sled 111 are in engagement with the nozzle arrays of the printhead cartridges, while in the down position the caps 113 and the wipers 115 are away from the path of the nozzle arrays. The carriage 51 and the sled 111 are configured such that wiping only takes place when the carriage moves to left after positioning the sled in the capping position pursuant to movement of the carriage to the right.

Figure 3:
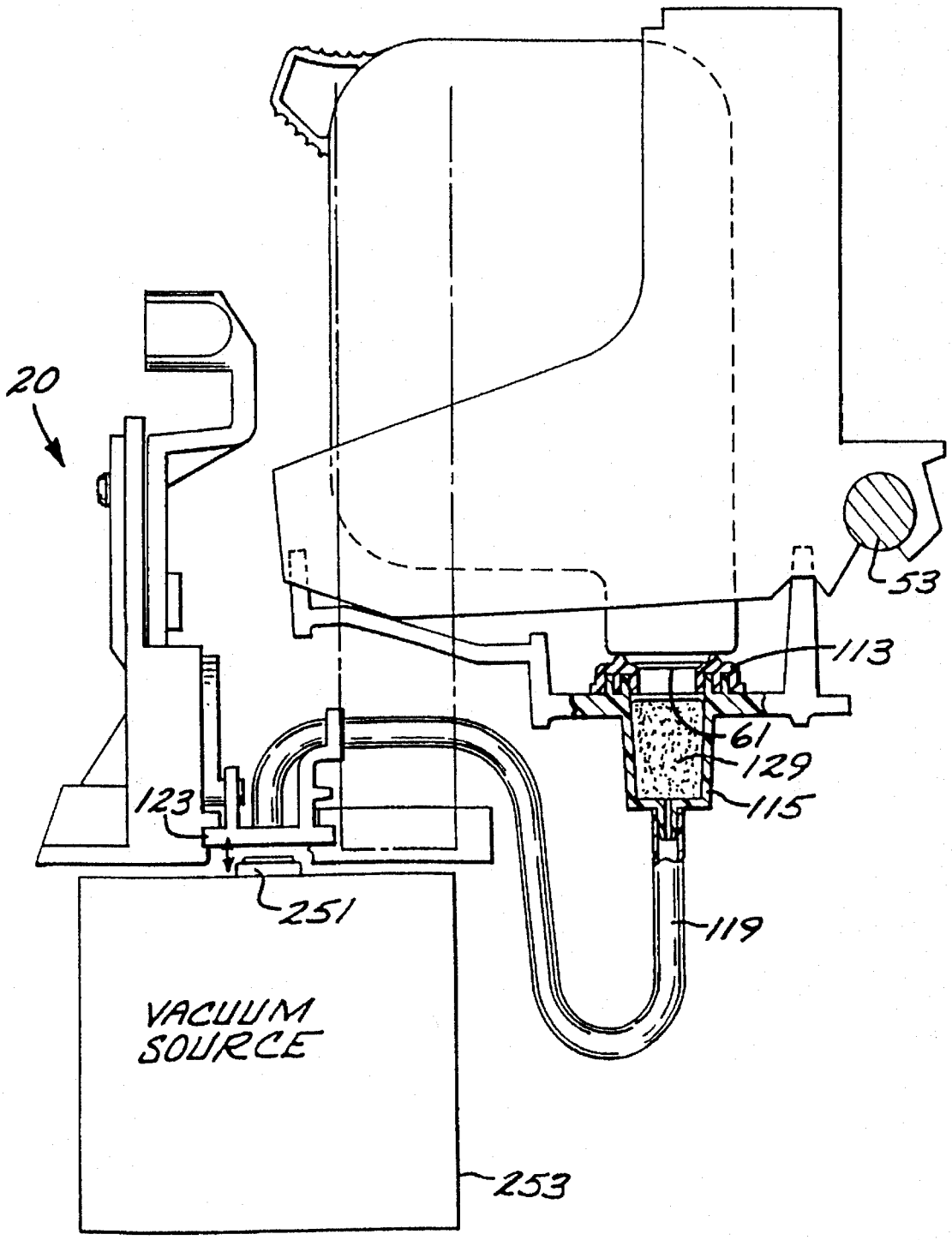
FIG. 3 is a schematic elevational partial sectional view showing connections between nozzle array sealing caps on the station sled and the selector assembly of the priming apparatus of the invention.

As shown in FIG. 3 for one of the caps 113, each cap 113 is secured to the top opening of a chamber 115 that extends downwardly and includes a lower port 117 that is connected to one end of a flexible tube 119 whose other end is connected to a corresponding fitting 121 of a slider 123 which includes a base 125 on which the fittings 121 are located. Respective bores 127 extend from the bottom of the base 125 through the top ends of the fittings 121 The slider 123 is part of a selector assembly, generally indicated by the reference numeral 20, that is located at the front of the service station to enable operator selection of the capped nozzle array that is to receive priming vacuum via a corresponding cap 113 engaged therewith. Each chamber 115 of the movable sled 111 can contain a filter 129 for trapping ink to prevent ink from entering and clogging the flexible tube 119. It should be appreciated that most of the ink that emerges from the nozzles pursuant to priming remains on the nozzle plate and is removed by the wipers 115 when the carriage 51 leaves the service station.

Figure 4:
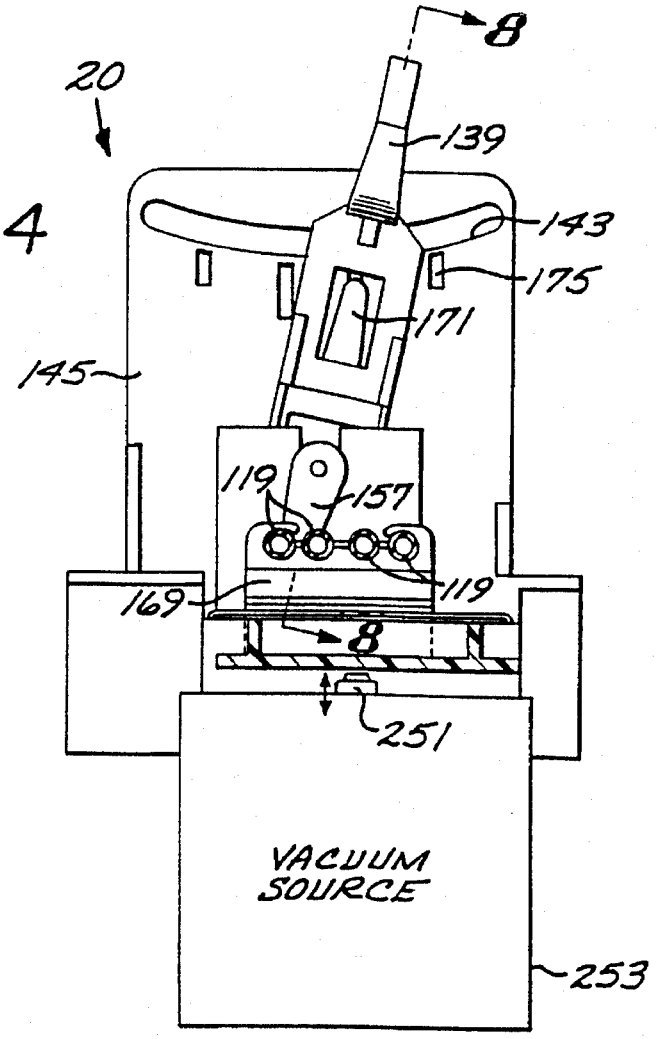
FIG. 4 is a schematic rear elevational view of the selector assembly of the priming apparatus of the invention.
Figure 5:
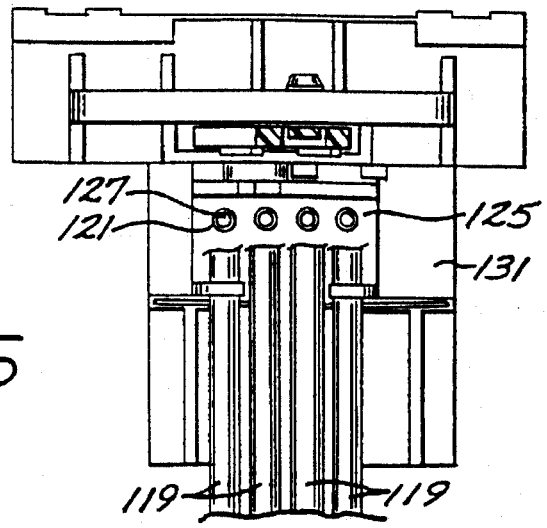
FIG. 5 is a schematic top plan view of a slider of the selector assembly of the priming apparatus of the invention.
Figure 7:
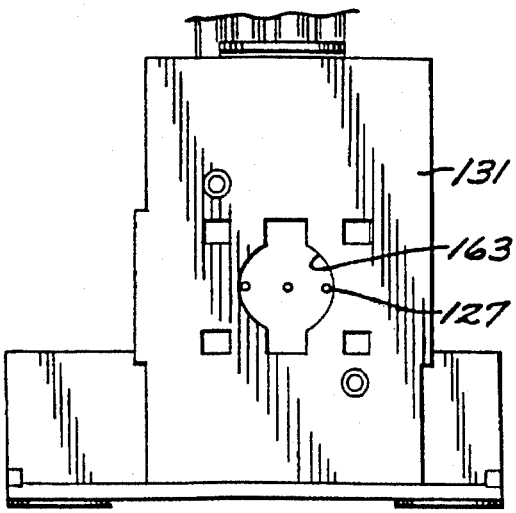
FIG. 7 is a schematic bottom plan view of the selector assembly of the priming apparatus of the invention.
Figure 8:
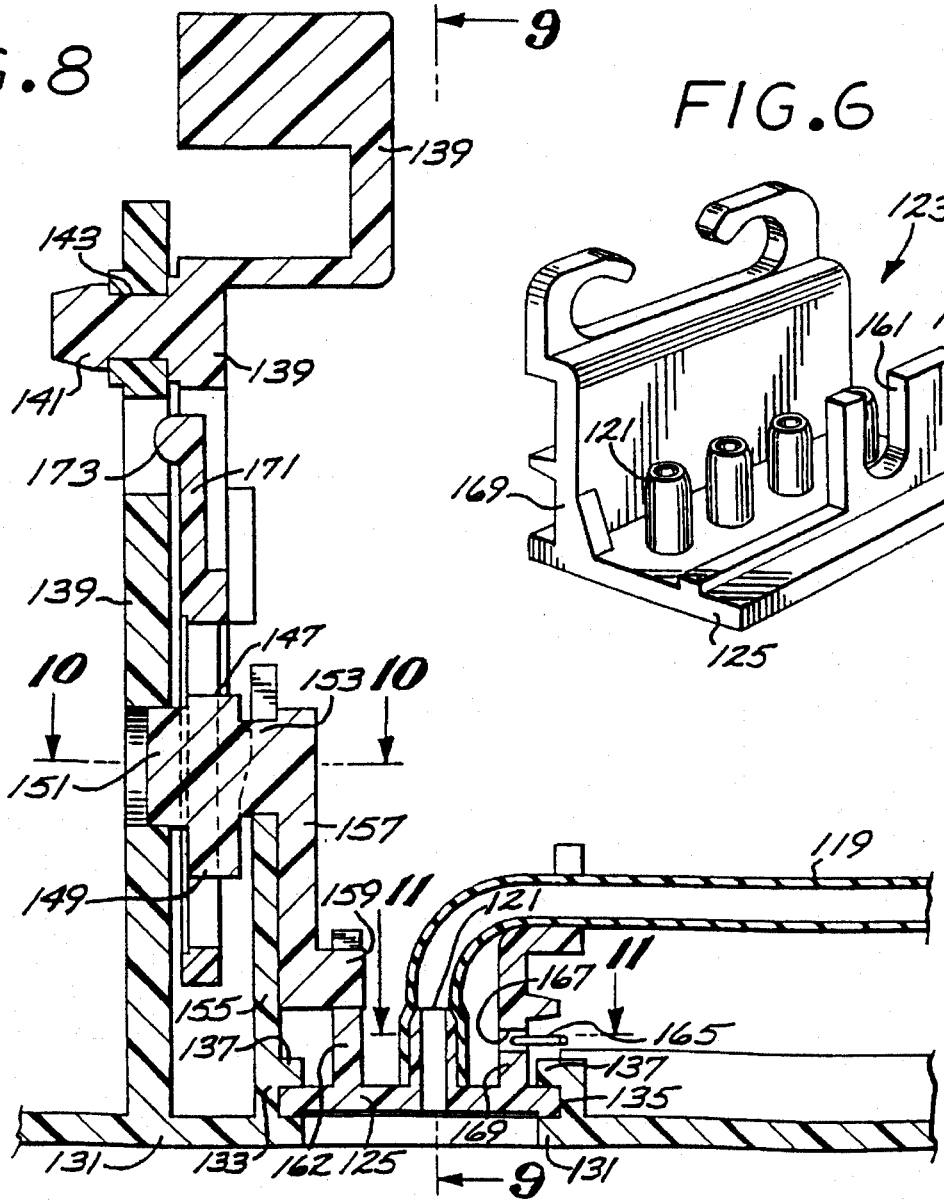
FIG. 8 is a schematic side elevational sectional view of the selector assembly of the priming apparatus of the invention.
Figure 6:
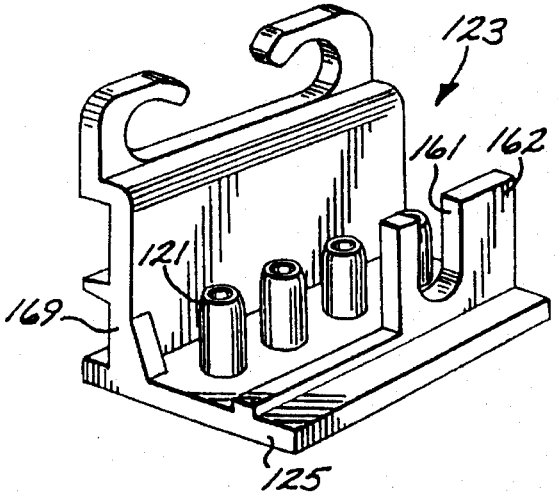
FIG. 6 is a schematic perspective view of a slider of the selector assembly of the priming apparatus of the invention.
Figure 9:
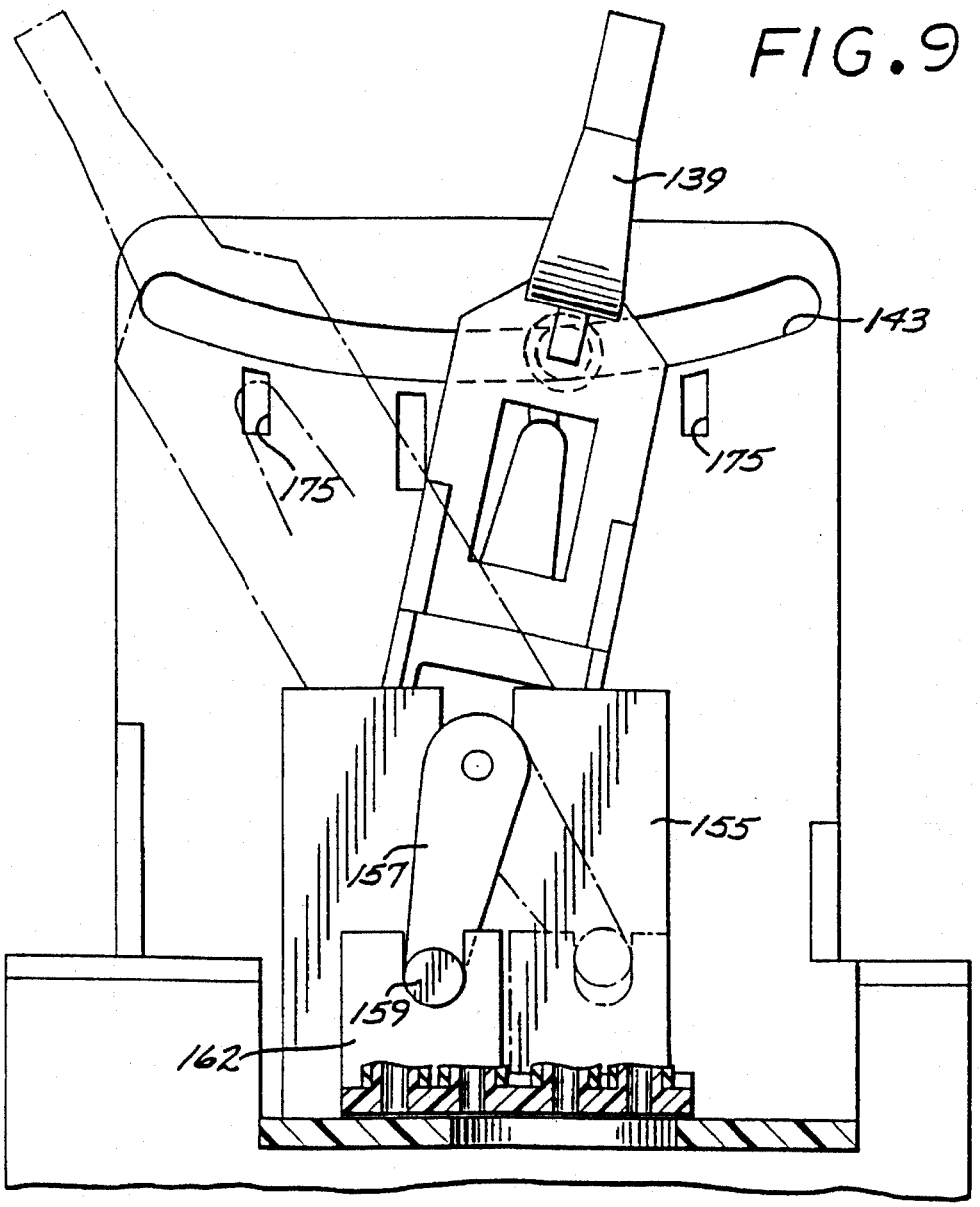
FIG. 9 is a schematic rear elevational view illustrating the operation of the selector assembly of the priming apparatus of the invention.
Figure 10:
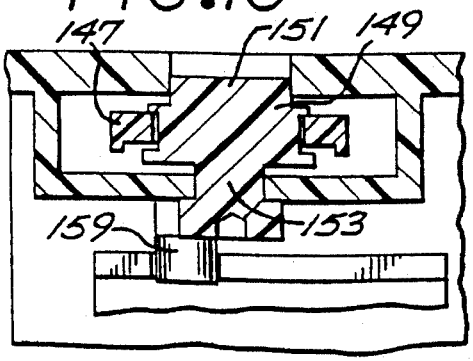
FIG. 10 is a schematic top plan sectional view illustrating the engagement between a selector lever and a rotatable slider block of the of the selector assembly of the priming apparatus of the invention.
Figure 11:
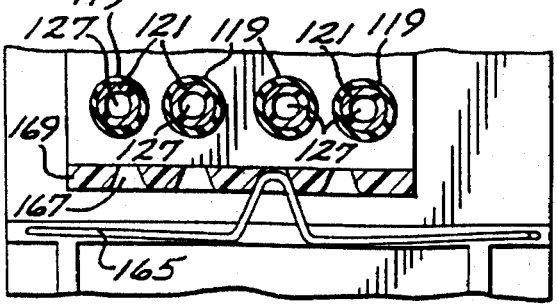
FIG. 11 is a schematic top plan sectional view illustrating a detent mechanism for locating the slider of the selector assembly of the priming apparatus of the invention.

As shown generally in FIGS. 4 and 5, the selector assembly includes a selector lever 139 that is linked to the slider 123 to cause the slider to move along a linear path that is parallel to the carriage axis. The fittings 121 are arranged linearly parallel to the carriage axis, and the slider is selectively positionable by means of detents at predetermined positions along its travel path at which a respective fitting is aligned with a vacuum cap 251 of a vacuum source 253. Pursuant to appropriate actuation, the vacuum source cap 251 travels upwardly through an opening 163 in a horizontal panel of the selector assembly 20 to briefly engage the bottom surface of the slider while negative pressure is at the opening of the vacuum source cap 251. Such negative pressure is transmitted to the printhead cartridge that is capped by the cap that is connected to the slider bore aligned with the vacuum source cap 251 at the time the vacuum source is actuated. By separating the vacuum source cap 251 from the bores of the slider, positive pressure is not applied to the nozzle arrays when the caps are brought into engagement with the printhead cartridges since venting is provided by the unobstructed bores in the slider. In other words, positive pressure is prevented by providing a vent path between the caps and the lower ends of the bores in the slider.

Referring more particularly to FIGS. 8–11, the slider 123 more particularly travels along the carriage axis in a guideway comprised of the top surface of the horizontal panel 131 of the selector assembly, two vertical walls 133, 135 disposed on the horizontal panel 131, and guide tabs 137 extending inwardly from the vertical walls. The slider 125 is moved by operator actuation of the lever 139 that includes a guide peg 141 attached thereto and slidably captured in an arcuate slot 143 formed in a vertical panel 145 that is attached to the horizontal panel 131. The lever 139 includes parallel arms 147 which extend downwardly relative to the guide peg 141 and are slidably engaged with a slide block 149 that is rotatably secured between the vertical panel 145 and a vertical wall 155 that is adjacent the vertical panel 145. In particular, the slide block 149 includes co-axial pins 151, 153 that are rotatably secured in openings in the vertical panel 145 and the vertical wall 155. A crank 157 extends from the pin 153 on the side of the vertical wall 155 that is away from the slide block 149 and is parallel to the parallel arms of the lever 139 when such parallel arms are engaged with the slide block 149. A pin 159 is located at the end of the crank away from the pin 153 and is slidably engaged in a slot 161 formed in a vertical wall 162 located adjacent the edge of the slider base 125 that is adjacent the vertical wall 155. Pursuant to the foregoing structure, movement of the selector lever 139 causes the slider block to rotate as the parallel arms 147 rotate and slide relative the slider block 149. Rotation of the slider block 149 causes the crank 157 to pivot such that the pin 159 moves in an arc. The arcuate motion of the pin 159 causes the slider 123 to move linearly since it is constrained to move only linearly and since the crank pin 159 slides up and down in the slot 161 as the horizontal component of its motion is transmitted to the slider 123.

As described earlier, a purpose of the selector assembly is to selectively position the slider 123 such that a selected bore 127 is aligned with the vacuum applying cap 251 that is located below the slider and which is controllably engaged against the bottom of the slider base through the opening 163 in a horizontal panel 131 of the selector assembly 20. In that regard, primary detent slots 167 are provided in a short vertical wall 169 located on the slider base 125 inboard of the guide tabs 137. The detent slots 167 are engaged by a V-shaped section of a wire detent spring 165 which includes ends that are located in holes at the ends of the vertical wall 135. The detent slots 167 and the V-shaped section of the detent spring 165 are configured such that engagement of the detent spring in a detent slot positions the slider with a corresponding slider bore 127 aligned with the vacuum cap 251. For tactile feedback in regard to the detent positioning of the slider 123, the selector lever 139 includes a detent arm 171 that extends upwardly from the parallel arms 147 and includes a detent bump 173 at an end thereof that is below the arcuate slot 143. The vertical panel 145 includes four auxiliary detent slots 175 that are located such that each detent slot secures the selector lever 139 at an angular position at which the slider is in a corresponding detent position with a corresponding slider bore 127 aligned with the vacuum cap 251.

In the foregoing selector assembly, by virtue of the arcuate slot 143 and the sliding engagement of the selector lever parallel arms 147 with the slider block 149, the top end of selector lever 139 tends to remain at approximately the same elevation while it changes angle pursuant to movement of the lever end generally along the carriage axis. Further, by virtue of the crank 157, the slider moves oppositely from the direction in which the end of the selector lever 139 is moved. Both of these factors provide for correlation of the selector lever position with the bore aligned with the vacuum source cap 251. For example, positioning the lever 139 to the left most detent position locates the slider to the rightmost position such that the leftmost slider bore is in alignment with the vacuum source cap 251. Lever position is further correlated with selection of a capped printhead cartridge for receiving priming vacuum by connecting each sled fitting 121 to the sled chamber that is correspondingly located along the carriage axis. In this manner, when the carriage 51 is in the capping position, the position of the selector lever 139 correlates with the printhead cartridge that can receive priming vacuum, such that a printhead cartridge is selected for priming by positioning the selector lever 139 at the position that corresponds to the position of the printhead cartridge on the carriage.

The priming vacuum source 253 can comprise a manually actuated vacuum generating primer which is selectively actuated to cause the vacuum source cap 251 to briefly engage the bottom surface of the slider base 125 while negative pressure is at the opening of the vacuum source cap 251, for example pursuant to manual actuation of a plunger. Such negative pressure is transmitted to the printhead cartridge that is capped by the cap that is connected to the slider bore aligned with the vacuum source cap 251 at the time the vacuum source is actuated.

Figure 12:
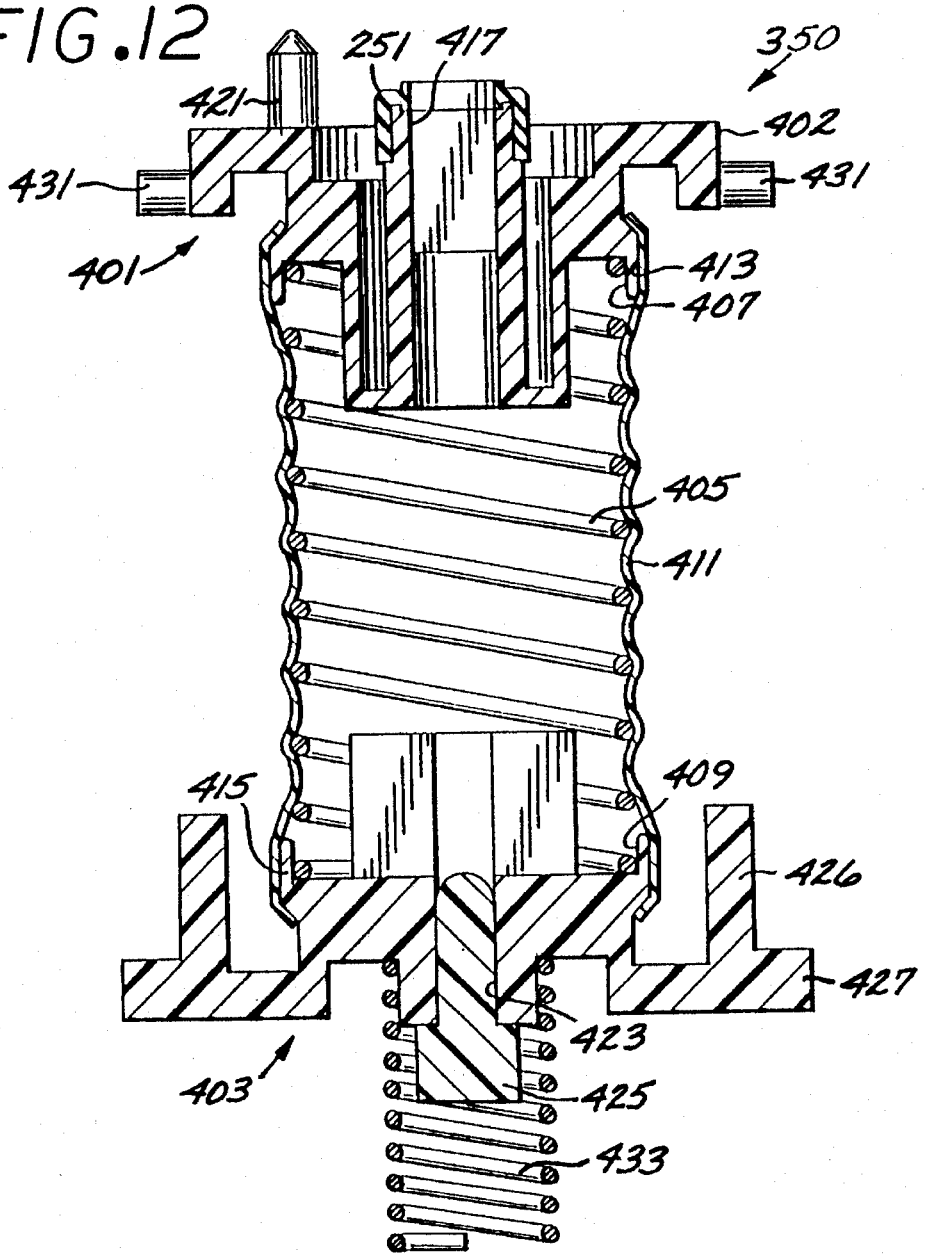
FIG. 12 is a schematic elevational sectional view illustrating the bellows assembly of a vacuum source that can be utilized in the primer apparatus of FIG. 1.
Figure 13:
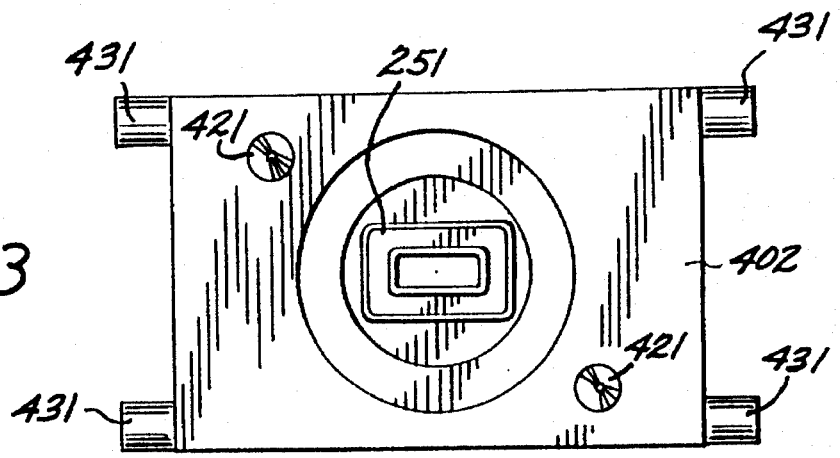
FIG. 13 is a top plan view of the upper end cap of the bellows assembly of FIG. 12.
Figure 14:
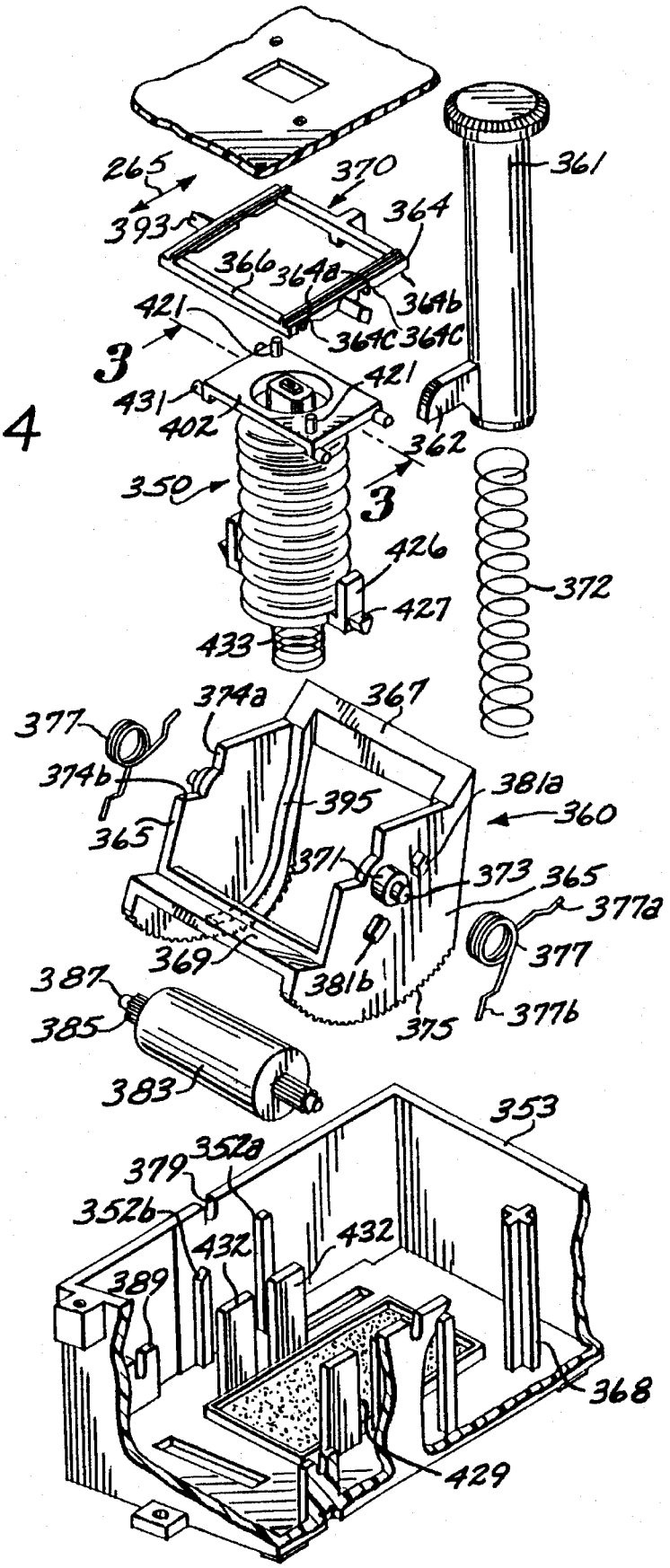
FIG. 14 is a perspective exploded view of the components of a vacuum source that can be utilized in the primer apparatus of FIG. 1 and which includes the bellows assembly of FIGS. 12 and 13.

Referring now to FIGS. 12–14, schematically depicted therein are components of an illustrative implementation of the vacuum source 253. Referring in particular to FIG. 12, set forth therein is a schematic sectional view of a bellows assembly 350 which supports the cap 251 and is a component of the vacuum source, as discussed further herein relative to FIG. 14. The bellows assembly 350 includes upper and lower end caps 401, 403, and an internal spring 405 having ends engaged in retaining recesses 407, 409 in the end caps 401, 403. A flexible, pliable sleeve 411 snugly surrounds the spring 405 and has its ends securely engaged around annular convex beads 413,415 formed in the proximal portions of the end caps 401, 403. The sleeve 411 is configured such that the internal spring 405 is slightly compressed when the bellows is fully expanded, whereby the length of the uncompressed bellows assembly is determined by the sleeve 411.

The upper end cap 401 (further shown in top plan view in FIG. 13) includes an axially oriented projection 417 having an opening that extends into the inside volume of the bellows assembly, and the cap 251 is fitted over the end of the projection 417 with its opening in communication with the opening of the projection 417. A top plate 402 surrounds the projection 417, and is separated therefrom by an intervening recess. The upper end cap 401 further includes pins 421 aligned with the longitudinal extent of the bellows assembly and located at diametrically opposite locations. As described further herein in conjunction with FIG. 14, the pins 421 are slidably engaged in corresponding openings in the overlying horizontal panel 131, and allow for movement of the upper end cap 401 along the longitudinal extent of the bellows assembly 350. Such movement is imparted to the upper end cap 401 by movement of laterally extending cam follower pegs 431 which are downwardly offset relative to the horizontal panel 131 so as to be lower than the peripheral edges of the horizontal panel 131.

The lower end cap 403 includes a centrally located bore 423 for retaining an ink permeable plug 425 that is sufficiently impermeable to air to allow the bellows assembly 350 to produce negative pressure at the opening of the cap 251 pursuant to expansion of the bellows assembly 350. The lower end cap 403 further includes diametrically opposite L-shaped guides 426, each having a radially extending section and an upwardly extending section. Cam follower pegs 427 extend radially from the guides 426.

In the vacuum source, the bellows assembly 350 is compressed and expanded by controllably moving the upper end cap 401 and the lower end cap 403 relative to each other. In particular, the end caps 401, 403 are constrained to be movable only along the longitudinal extent of the bellows assembly 350, and the cam follower pegs 431 of the upper end cap 401 and the cam follower pegs 427 of the lower end cap 403 are engaged against respective cam surfaces that control the movement of the end caps along the longitudinal extent of the bellows assembly. By way of illustrative implementation, cam surfaces for the cam follower pegs 431 of the upper end cap 401 engage the top portion of the pegs while the cam surfaces for the cam follower pegs 427 of the lower end cap 403 engage the bottom portion of the pegs, and the bellows assembly 350 is of sufficient length such that it is partially compressed when it is at its maximum expansion as allowed by the cam surfaces. In this manner, the cam follower pegs 427, 431 are continuously providing an expanding bias against their associated cam surfaces.

Referring now to FIG. 14, set forth therein is an exploded perspective view of components of the vacuum source that cooperate with the bellows assembly 350 to achieve the application of priming negative pressure to the cap 251. The L-shaped guides 426 of the bellows assembly are slidably engaged in vertical slots 429 formed by the adjacent edges of vertically extending guide members 432 attached to the bottom of a base housing 353, while the pegs 421 of the bellows assembly upper end cap 401 are slidably engaged in apertures in the overlying horizontal panel 131 which are located such that the upper and lower end caps 401, 403 are aligned with each other along the longitudinal extent of the bellows assembly 350, and the displacement of the end caps 401, 403 will be along the longitudinal extent of the bellows assembly 350.

The vertical position of the upper end cap 401 is controlled by engagement of the cam follower pegs 431 against cam surfaces on the bottom of parallel cam members 364 of a rectangular slider 370 that surrounds the top plate 402 of the upper end cap 401. The parallel cam members 364 are positioned tangentially to corresponding edges of the upper end cap top plate 402, and are fixed relative to each other by parallel support members 366 located between the ends of the parallel cam members 364. The parallel cam members 364 are slidably biased against the inside surface of the horizontal panel 131 by the cam follower pegs 431 of the upper end cap 401. Pursuant to the position of the cam members 364 relative to the horizontal panel 131, the movement of the slider 370 is constrained to be along the cam members 364 as indicated by the double arrow 265 in FIG. 14. Actuating pegs 393 extend laterally from the parallel cam members 364 and are engaged to move the slider 370 along the axis 265, as described more fully herein.

The vertical position of the lower end cap 403 is controlled by engagement of the cam follower pegs 427 against cam surfaces 395 formed on the inner opposing surfaces of parallel plate-like gear sectors 365 of a rotatable cam assembly 360. A helper spring 433 is located between the lower end cap 403 and an ink absorbing pad located at the bottom of the base housing 353 provide an upward bias on the lower end cap that facilitates the upward movement of the lower end cap 403 pursuant to movement of the cam surfaces 395 against the cam follower pegs 427 of the lower end cap. The gear sectors 365 of the cam assembly 60 are fixed to each other by cross members 367,369, and the cam surfaces 395 on their inside surfaces are mirror images of each other. A cylindrical spacer 371 and a spindle 373 are located on each gear sector 365 with both spacers and both spindles being coaxial on the line formed by the axial centers of gear sections 375 of each gear sector. Torsional coiled wire springs 377 are positioned around the cylindrical spacers 371 with the ends 377*a*, 377*b* of each wire forming a spring extending beyond positioning stops 381*a*, 381*b* formed on the gear sectors at appropriate locations. The spindles 373 are rotatably supported in slots 379 formed in the upper edges of the front and rear walls of the base housing 353. Rotation of the cam assembly 360 in conjunction with the downward bias of the lower end cap 403 and the upward bias of the helper spring causes the lower end cap 403 to move up and down along the slots 429. The upwardly extending portions of the L-shaped guides 426 prevent the rotation of the guides 426 as they move up an down in the vertical slots 429, thereby maintaining the orientation of the lower end cap as it moves up an down in the slots 429.

The gear sectors of the cam assembly 360 further include slider engaging edges 374*a*, 374*b* formed in the gear sectors at locations opposite the gear teeth. The engaging edges 374*a*, 374*b* are configured to move the slider 370 by engagement with the actuating pegs 393 of the slider at appropriate positions in the rotations of the cam assembly 360.

Referring now to FIG. 15, schematically illustrated therein is the profile of each of the cam surfaces 395. The profile includes a lower dwell section D1 that defines the lowest vertical position for the lower end cap 403, a vertical movement section M, and an upper dwell section D2 that defines the highest position for the lower end cap 403. The lower dwell section D1 and the upper dwell section D2 are of respective constant radii relative to the spindle axis, wherein the radius of the lower dwell section D1 is greater than the radius of the upper dwell section D2. The points of the vertical movement section M are at different distances from the spindle axis with such distance decreasing from the radius of the lower dwell section at the end of the vertical displacement section closest to the lower dwell section D1 to the radius of the upper dwell section at the end of the vertical movement section M closest to the upper dwell section D2.

The gear sectors 365 of the cam assembly 360 include gear teeth 375 which are engaged with pinion gears 385 located on either side of a cylindrical flywheel 383 and coaxial therewith. Spindles 387 outboard of the pinion gears are slidably engaged in slots of flywheel supporting members 389 formed on the inside of the front and rear walls of the base support 353. Thus, the flywheel rotates with the rotation of the cam assembly 360.

For reference, clockwise rotation of the cam assembly will refer to rotation of the cam assembly which moves the support member 367 toward the cam follower pegs 427 of the lower end cap 403, which is consistent with the perspective view of FIG. 14, and the cam profile of FIG. 15.

The operation as well as further details of the vacuum source will now be discussed relative to the clockwise (CW) and counterclockwise (CCW) rotation of the cam assembly 360, the displacements of the upper end cap 401, the lower end cap 403, and the slider 370; the cam assembly rotation interval during which the spring ends 377*a* are tensioned; the cam assembly rotation interval during which one of the spring ends 377*b* is tensioned; and the negative pressure (suction) at the opening of the cap 251.

A resting angular position for the cam assembly 360 is defined by the lower dwell section D1 of the cam surfaces 395 and a stop 352*b* located on the inside surface of the rear wall of the base housing 353 and engageable by the spring end 377*b* of the spring 377 adjacent such rear wall. In particular, the resting angular position is defined by locating the stop 352*b* such that spring end 377*b* rests in a non-tensioned manner on the stop 352*b* when the cam assembly is angularly positioned with a portion of the dwell section D1 close to the vertical displacement section M engaged with the cam follower pegs 427. If the cam assembly 360 is rotated in the counterclockwise direction from the angular resting position, the spring end 377*b* will be tensioned which will cause the cam assembly 360 to rotate clockwise to its angular resting position when the rotation causing force is removed. If the cam assembly 360 is rotated clockwise away from its angular resting position, the lower end cap 403 is raised by engagement of the vertical movement section M of the cam surfaces 395 with the cam follower pegs 427, and the downward bias of the cam follower pegs 427 will tend to rotate the cam assembly 360 counterclockwise to its angular resting position when the rotation cause force is removed.

The slider 370 is in the leftmost position at the start of a priming operation, and it will be placed at such position at the end of a vacuum generating operation as described further herein. The slider 370 is readily initialized to the leftmost position by operating the vacuum source as more particularly described herein.

The cam assembly 360 is configured such that the support member 367 is at its highest position when the cam assembly is at its angular resting position. The support member 367 is engageable by an actuating tab 362 of a plunger 361 pursuant to depression of the plunger 361 which is constrained for vertical travel along a guide rod 368 secured to the bottom of the base housing 353. The upward vertical movement of the plunger is appropriately limited, and a coil spring 372 provides expanding bias that restores the plunger to a raised position when it is released after being depressed.

Depression of the plunger 361 with the actuating tab 362 engaged on the top of the support member 367 causes the cam assembly 360 to rotate in the clockwise direction. As the cam assembly rotates, the vertical movement section M of the cam surfaces 395 causes the lower end cap 403 to move upwardly, thereby compressing the bellows assembly 350, and the cam edges 377*b* eventually engage the cam follower pegs 393 of the slider 370. The movement of the slider to the right eventually slides the angled cam surfaces 364*c* of the slider 370 into engagement with the cam follower pegs 431 of the upper end cap, which then causes the slider 370 to snap to the right pursuant to upward bias exerted by the cam follower pegs 431 against the angled ramp surfaces 364*c*, which allows the upper end cap 401 of the bellows assembly to move upwardly as the angled cam surfaces 364*a* and then the recessed cam surfaces 364*c* of the cam members 364 slide against the cam follower pegs 431. The slider 370 and the cam surfaces 395 are configured such that only the upper dwell section D1 is sliding against the cam follower pegs 427 of the lower end cap 403 when the upper end cap 401 moves upwardly to engage the cap 251 against the bottom surface of the base 125 of the slider 123. In this manner, the lower end cap 403 is stationary while the upper end cap 401 moves upwardly, which produces negative pressure at the opening of the cap 251 as it seals against the bottom surface of the base 125 of the slider 123.

As the cam assembly 360 continues to rotate clockwise pursuant to continued depression of the plunger 361, the spring ends 377*a* engage stops 352*a* located on the front and rear walls of the lower base 353. Pursuant to such engagement, the spring 377 is tensioned as the cam assembly 360 continues to be rotated clockwise by the downward movement of the plunger 361. The engagement of the spring ends 377*a* against the stops 352*a* is represented in FIG. 16 by the line A.

As the cam assembly rotates clockwise, the support member 367 moves further away from the plunger by virtue of the circular path it is following, and the actuating tab 362 eventually bypasses the support member 367. After the support member 367 is free of the actuating tab 362, the cam assembly slows and then begins rotating in the counterclockwise direction pursuant to the tension of the springs 377. At the beginning portion of the counter-clockwise rotation, the pressure at the opening of the vacuum source cap 251 does not change by virtue of the upper dwell section D2 of the cam surfaces 395. With continuation of the counterclockwise rotation, the lower end cap 403 moves downwardly by virtue of the vertical displacement section M of the cam surfaces 395, whereby the bellows assembly 350 expands to make the pressure at the opening of the vacuum source cap 251 more negative than the initial negative pressure produced upon engagement of the cap 251 against the bottom surface of the base 125 of the slider 123, which causes ink to be suctioned out of the nozzle array whose cap is connected to slider bore that is selectively aligned with the cap 251. As a result of the inertia of the flywheel 383, the rotation of the cam assembly 360 is slowed, whereby the ink suctioning negative pressure is applied over a longer time interval than would be provided if the cam assembly 360 were rotated without the flywheel 383.

As the cam assembly 360 continues its counterclockwise rotation, the spring ends 377*a* eventually become disengaged from the stops 352*a*, but the cam assembly 360 continues to rotate counterclockwise pursuant to the rotational momentum of the flywheel 383. Prior to reaching its resting angular position, the cam edges 374*a* engage the cam follower pegs 395 of the slider and move the slider 370 to the left with the counterclockwise rotation, which causes the angled surfaces 64*c* and then the non-recessed surfaces 364 to slide over the cam follower pegs 431, thereby causing the upper end cap to be moved downwardly. The slider 370, the cam edges 374*a*, and the cam surfaces 395 are configured such that while the upper end cap 401 is moving downwardly, the lower end cap 403 moves downwardly at a greater rate than the rate of the downward movement of the upper cap, whereby negative pressure is present at the opening of the cap 251 as it is being disengaged from the bottom surface of the base 125 of the slider 123. The negative pressure during disengagement of the cap 251 from the bottom surface of the base 125 can be less than the ink suctioning negative pressure.

By virtue of the momentum of the flywheel as well as its own momentum, the cam assembly continues to rotate in the counterclockwise direction past its resting angular position until the spring end **377*b* engages the stop 352. This causes the cam assembly 360 to stop its counterclockwise rotation and then rotate clockwise to its resting angular position, which insures that the support member 367 is in the path of the actuating tab 362 and therefore ready for the next priming operation. The engagement of the spring end 377*b* against the stop 352*b* is represented in FIG. 16** by the line B.

Release of the pressure on the plunger 361 allows it to move upwardly pursuant to the upward bias of the spring 372. The top edge of the actuating tab 362 eventually contacts the support member and causes the cam assembly to the rotate counterclockwise, which tensions the spring end **377*b* against the stop 352*b*. When the actuating tab 362 clears the support member 367, the tension of the spring 377** causes the cam assembly to rotate clockwise to its resting angular position.

For further description of the vacuum source described above and shown in FIGS. 12–14, reference is made to copending U.S. application Ser. No. 08/056,012, filed Apr. 30, 1993, by K. L. Glassett and S. W. Bauer for "IN-LINE/OFF-LINE PRIMER FOR INK JET CARTRIDGE," U.S. Pat. No. 5,420,619 which is incorporated herein by reference.

Figure 17:
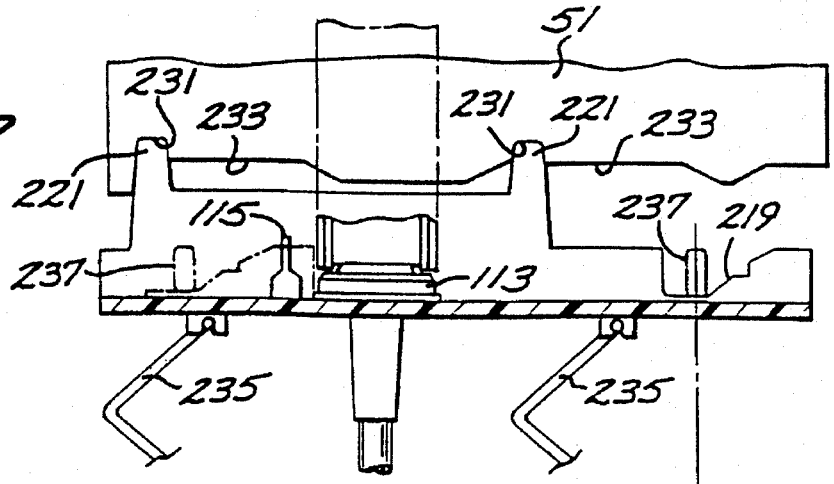
FIG. 17 is a schematic elevational view illustrating the sled of the printer of FIG. 1 in a capping position with printhead nozzle arrays capped by caps on the sled.

Referring now to FIGS. 17–22, the sled 111 and the carriage 51 cooperate as follows to cap the nozzle arrays of the printhead cartridges and to wipe the nozzle arrays when the carriage moves away from engagement of the sled in the capped position. As shown in FIG. 17, when the sled is in the capping position, it is in its vertically highest position such that the caps 113 are in engagement with the printhead nozzle arrays that are overlying the caps as a result of movement of the carriage to the right to position the sled in the capping position. In the capping position, the prongs 221 of the sled are engaged in slots 231 of the carriage, and the lowest portion of the cam surfaces 219 are engaged against the stationary pegs 237 pursuant to the upward bias of the sled by the springs 235. As the carriage is moved to the left toward the center of the printer, the sled is moved to the left by virtue of the prongs 221 being contained in the slots 231 of the carriage. As the sled is moved to the left, it is vertically lowered away from the printhead cartridges as sloped portions of the cam surfaces 219 slide across the stationary pegs 237. Notches in the cam surfaces eventually engage the stationary pegs, at which time the sled prongs 221 are clear of slots 231 in the carriage 51. As the carriage continues its movement to the left, the prongs 221 remain clear of the cam surfaces 233 of the carriage 51, and sled remains stationary while the nozzle arrays of the printhead cartridges slide over the resilient wipers 115. Continued movement of the carriage causes bumps in the cam surfaces 233 of the carriage 51 to engage the prongs 221 which causes the sled to move downward and to the left as the notches in the sled cam surfaces 219 disengage from the stationary pegs 237 sloped portions of the sled cam surfaces slide against the stationary pegs. The downward and to the left movement of the sled continues until horizontal portions of the sled cam surfaces become engaged with the stationary pegs 237 at which time the prongs 221 are clear of the bumps in the carriage cam surfaces 233. The sled is then in its down position wherein the upper edges of the wipers are vertically lower than the printhead nozzle arrays.

The sled is moved to the capping position pursuant to engagement of the prongs 221 by the carriage slots 231 as the carriage moves to the right. Since the sled is in the down position, the printhead nozzle arrays remain higher than the wipers until the carriage slots engage the prongs 221, at which time the printhead nozzle arrays are positioned over the caps 113. Continued movement of the carriage to the right causes the sled to move up and to the right with the carriage as the sled cam surfaces 219 slide across the stationary pegs 237. Eventually, the caps come into engagement with the printhead nozzle arrays, with the alignment between the nozzle arrays and the caps being controlled by the relative positioning of the slots 231 of the carriage and the prongs 221 of the sled 111.

More specific information as to the operation of the sled 111 relative to the carriage 51 is more particularly described in commonly assigned copending U.S. application Ser. No. 08/056,327, filed Apr. 30, 1993, by Heinz Waschhauser and William Osborne for "SERVICE STATION HAVING REDUCED NOISE, INCREASED EASE OF ASSEMBLY AND VARIABLE WIPING CAPABILITY," which is incorporated herein by reference; and in commonly assigned copending U.S. application Ser. No 07/949,197, filed Sep. 21, 1992, by William S. Osborne for "INK-JET PRINTHEAD CAPPING AND WIPING METHOD AND APPARATUS," which also incorporated herein by reference.

Although the foregoing has been a description and illustration of specific embodiments of the invention, various modifications and changes thereto can be made by persons skilled in the art without departing from the scope and spirit of the invention as defined by the following claims.

What is claimed is:

1. A thermal ink jet printer comprising:

a print carriage;

a printhead cartridge supported by said print carriage, said printhead cartridge having a nozzle array;

capping means for sealingly surrounding the printhead nozzle array pursuant to engagement of said capping means with the printhead cartridge;

means for causing said capping means to engage said printhead cartridge;

vacuum conveying means for conveying priming vacuum to said capping means;

a manually actuated source of priming vacuum having a vacuum source cap spaced apart from said vacuum conveying means, said source of priming vacuum being selectively actuated to produce vacuum at said vacuum source cap and said vacuum source cap selectively engaging said vacuum conveying means for application of vacuum thereto, whereby positive pressure is not produced when said capping means is brought into engagement with said printhead cartridge;

whereby said printhead cartridge is primed without removal thereof from said carriage and without use of a motorized vacuum pump.

2. The thermal ink jet printer of claim 1 wherein said means for causing said capping means to engage said printhead cartridge includes a movable sled located adjacent a print area of the printer for supporting said capping means.

3. The thermal ink jet printer of claim 1 wherein said manually actuated source of priming vacuum comprises:

an elongated resilient bellows compressible along its length and having a first end cap and a second end at ends of said elongated resilient bellows, said first end cap having an opening where negative pressure is produced when said first and second end caps are relatively displaced away from each other;

said first end cap of said elongated resilient bellows supporting said vacuum source cap which selectively engages said conveying means to form a seal therewith so that the negative pressure produced in said opening of said first end cap is communicated to the nozzle array;

first moving means for moving said first end cap between a retracted position and an extended position along the length of said bellows so as to cause said first end cap and said second end cap to be displaced relative to each other, wherein movement of the first end cap from the retracted position to the extended position is away from the second end cap;

means for controlling priming of the nozzle array, said controlling means including (a) second moving means for moving the second end cap toward the first end cap while the first end cap is stationary, (b) actuating means for actuating said first moving means to move the first end cap to the extended position while the second end cap is stationary so as to produce negative pressure at the opening of the said vacuum source cap, (c) third moving means for moving the second end cap away from the first end cap while the first end cap is stationary so as to produce an ink suctioning negative pressure at the opening of said vacuum source cap, and (d) fourth moving means for moving the first end cap toward the second end cap while moving the second end cap away from the first end cap at a rate that is greater than the rate at which the first end cap is moving toward the second end cap such that negative pressure is produced at the opening of said vacuum source cap; and manually actuated plunger means for actuating said priming controlling means;

whereby negative pressure is produced at the opening of said vacuum source cap at all times that said first end cap is in the extended position.

* * * * *